US011045691B2

(12) United States Patent
Hwang et al.

(10) Patent No.: US 11,045,691 B2
(45) Date of Patent: Jun. 29, 2021

(54) GOLF BALL WITH DIMPLE PATTERN ARRANGED IN SPHERICAL POLYGONS HAVING SIDES WITH DIFFERENT LENGTHS

(71) Applicant: VOLVIK INC., Chungcheongbuk-do (KR)

(72) Inventors: In Hong Hwang, Namyangju-si (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 694 days.

(21) Appl. No.: 13/949,610

(22) Filed: Jul. 24, 2013

(65) Prior Publication Data

US 2015/0031476 A1 Jan. 29, 2015

(30) Foreign Application Priority Data

Apr. 4, 2013 (KR) ..... 10-2013-0037007

(51) Int. Cl.
*A63B 37/12* (2006.01)
*A63B 37/14* (2006.01)
*A63B 37/00* (2006.01)

(52) U.S. Cl.
CPC ..... *A63B 37/0006* (2013.01); *A63B 37/002* (2013.01); *A63B 37/0004* (2013.01); *A63B 37/0018* (2013.01); *A63B 37/0021* (2013.01)

(58) Field of Classification Search
CPC ..... A63B 37/0006; A63B 37/0007; A63B 37/0008; A63B 37/0009; A63B 37/001; A63B 37/0011; A63B 37/0012–0021
USPC ..... 473/378–384
See application file for complete search history.

(56) References Cited

U.S. PATENT DOCUMENTS 4,946,167 A * 8/1990 Yamada ..... A63B 37/0004 473/384
4,973,057 A * 11/1990 Morell ..... A63B 37/0004 473/383
4,982,964 A * 1/1991 Morell ..... A63B 37/0004 40/327

(Continued)

FOREIGN PATENT DOCUMENTS

KR 1019950014583 12/1995
KR 100852269 8/2008

*Primary Examiner* — Eugene L Kim
*Assistant Examiner* — Matthew B Stanczak
(74) *Attorney, Agent, or Firm* — Harness, Dickey & Pierce, P.L.C.

(57) ABSTRACT

Provided is a spherical polyhedron division structure of a golf ball where dimples are arranged to have a well-defined symmetry and a dimple pattern. In the spherical polyhedron division structure, wherein an arbitrary point on a surface of a spherical body constituting a golf ball is defined as a pole, a great circle dividing the spherical body into a northern hemisphere and a southern hemisphere with respect to the pole as a reference point is defined as an equator, the surface of the spherical body is divided into six areas formed by segments connecting the pole and points obtained by dividing the equator in units of 60°, each area is divided into spherical polygons formed by four spherical rectangles and two spherical triangles having sides with different lengths, and the spherical polygons arranged in different adjacent areas are symmetric with each other.

5 Claims, 4 Drawing Sheets

(56) References Cited

U.S. PATENT DOCUMENTS 5,009,428 A * 4/1991 Yamagishi ..... A63B 37/0004 473/384
5,072,945 A * 12/1991 Oka ..... A63B 37/0004 40/327
5,078,402 A * 1/1992 Oka ..... A63B 37/0004 40/327
5,890,974 A * 4/1999 Stiefel ..... A63B 37/0004 473/384
7,238,121 B2 * 7/2007 Watanabe ..... A63B 37/0004 473/368
2003/0045379 A1 * 3/2003 Sajima ..... A63B 37/008 473/378
2003/0050138 A1 * 3/2003 Kasashima ..... A63B 37/002 473/384
2003/0232667 A1 * 12/2003 Kasashima ..... A63B 37/0045 473/378
2005/0032590 A1 * 2/2005 Kasashima ..... A63B 45/00 473/378
2006/0025244 A1 * 2/2006 Yokota ..... A63B 37/0033 473/378
2006/0030428 A1 * 2/2006 Ohira ..... C09D 175/06 473/378
2006/0035726 A1 * 2/2006 Kasashima ..... A63B 37/0004 473/383
2006/0068941 A1 * 3/2006 Sajima ..... A63B 37/0012 473/378
2006/0116222 A1 * 6/2006 Sajima ..... A63B 37/0012 473/383
2007/0049423 A1 * 3/2007 Nardacci ..... A63B 37/0089 473/378
2010/0004072 A1 * 1/2010 Komatsu ..... A63B 37/0022 473/377
2010/0190584 A1 * 7/2010 Sajima ..... A63B 37/002 473/384
2011/0034274 A1 * 2/2011 Sajima ..... A63B 37/0021 473/384
2014/0357404 A1 * 12/2014 Ichinose ..... A63B 37/0006 473/371
2015/0031476 A1 * 1/2015 Hwang ..... A63B 37/0004 473/383
2015/0105181 A1 * 4/2015 Hwang ..... A63B 37/0019 473/381
2015/0119168 A1 * 4/2015 Inoue ..... C08K 3/346 473/373
2015/0306461 A1 * 10/2015 Parsons ..... A63B 37/0006 473/384
2016/0067552 A1 * 3/2016 Hixenbaugh ..... A63B 37/0089 473/383
2017/0157468 A1 * 6/2017 Mimura ..... A63B 37/008
2017/0165528 A1 * 6/2017 Takihara ..... A63B 37/0045
2017/0173402 A1 * 6/2017 Sajima ..... A63B 37/0063
2018/0028873 A1 * 2/2018 Takihara ..... A63B 37/0033
2018/0036599 A1 * 2/2018 Inoue ..... A63B 37/0003
2019/0192921 A1 * 6/2019 Takubo ..... A63B 37/0018

* cited by examiner

GOLF BALL WITH DIMPLE PATTERN ARRANGED IN SPHERICAL POLYGONS HAVING SIDES WITH DIFFERENT LENGTHS

CROSS-REFERENCE TO RELATED APPLICATIONS

This application is based upon and claims the benefit of priority from Korean Patent Application No. 10-2013-0037007 filed on Apr. 4, 2013, the entire contents of which are incorporated herein by reference.

BACKGROUND

1. Field of the Invention

The present invention relates to a spherical polyhedron division structure of a golf ball where dimples are arranged to have a well-defined symmetry and a dimple pattern.

2. Description of the Related Art

Dimples of a golf ball have a very important role aerodynamically when the ball is flying in the air. In addition, the dimples are one of the key elements directly influencing flight performance of the golf ball.

When a golf ball is hit by a golf club, the golf ball is flying with a reverse rotation according to a loft angle of the golf club. At this time, since the dimples are arranged on the surface of the golf ball to have an appropriate symmetry, the golf ball can be flying to destination straightly without deflection.

If the dimples are arranged on the surface of the golf ball without overall symmetry, the golf ball may be deflected leftward or rightward. Therefore, in order to allow the golf ball to fly to the destination straightly without deflection, it is very important the dimples are arranged on the surface of the golf ball with overall symmetry.

For this reason, R&A (Royal and Ancient Golf Club) and USGA (The United States Golf Association) regulates symmetry ball as well as a total flight distance of a golf ball in a rule of official golf ball. In the rule, two poles are marked on the golf ball, and a seam line (formation joint line; it denotes the equator in this invention) perpendicular to a segment connecting the two poles is marked on the golf ball. The golf ball is tested by using a mechanical golfer in an indoor test field. In this test, the golf ball starts flying in initial conditions: a loft angle of a golf club of 10±0.5°; rotation of 42±2.0 rps; a swing speed of 120±0.5 mph; a speed of the golf ball of 256 fps. The golf ball is hit in the two directions. The one direction is a PH (poles horizontal) ball flying direction where a line connecting the two poles is used as a rotation axis and the gall is flying so that the seam portion is rotated in the flying direction. The other direction is a PP (pole over pole) ball flying direction where a formation joint line (seam) is used as a rotation axis, and the ball is flying so that the pole portions are rotated in the flying direction. As a result of the hitting, if a difference in flight distance is larger than 4.0 yards or an average difference in flight time is larger than 0.4 seconds, the golf ball is not in accordance with the rule of symmetry of R&A and USGA so that the golf ball is not officially approved.

Since the dimple pattern of the golf ball is a key element influencing the flight performance of the golf ball, various dimple patterning methods have been proposed in order to implement a complete symmetry of dimples arranged on the surface of the golf ball. The dimple pattern which is used most widely until now is a pattern where a surface of a golf ball (spherical body) is divided into a plurality of spherical polygons and dimples are arranged to have symmetry.

In general, the following spherical polyhedrons are used to arrange dimples in a symmetric pattern in a golf ball.

The spherical polyhedrons include a spherical tetrahedron formed by four spherical triangles, a spherical hexahedron formed by six spherical squares, a spherical octahedron formed by eight spherical triangles, a spherical cube octahedron formed by six spherical squares and eight spherical triangles, a spherical icosahedron formed by 20 spherical triangles, a spherical icosidodecahedron formed by 12 spherical pentagons and 20 spherical triangles, and the like. A large number of spherical polyhedron division structures are proposed.

In the above-described spherical polyhedron division structures of the golf ball, the spherical polygons constituting each spherical polyhedron are spherical equilateral polygons having the same sides and angles.

For example, the spherical icosahedron is formed by 20 spherical equilateral triangles, and the spherical octahedron is formed by 8 spherical equilateral triangles. In addition, the spherical icosidodecahedron which is formed by segments connecting middle points of adjacent sides of large spherical triangles of a spherical icosahedron is formed by 20 spherical equilateral triangles and 12 spherical equilateral pentagons.

As described above, it can be understood that the spherical polyhedrons which have been used so as to provide symmetry to a dimple pattern of a golf ball are configured with spherical equilateral polygons having sides with the same lengths and the same angles.

On the other hand, a golf ball hit by a golf club is flying to the apex of trajectory at a high speed (high speed zone), and the golf ball is flying from the apex to the landing position at a low speed (low speed zone).

In the case where dimples are formed on the surface of the golf ball, a total area ratio of the dimples for obtaining a necessary lift force in the high speed zone needs to be at least in a range of 76% to 77% with respect to the entire surface area of the golf ball. Furthermore, the number of large-sized dimples having a diameter of 0.145 inch or more needs to be about 60% or more of a total number of dimples, so that the lift force for allowing the golf ball to fly in a basic flight distance can be obtained.

On the contrary, even in the case where the total area ratio of the dimples is 76% or more, if the number of the dimples having a diameter of 0.145 inch or more is less than 60%, it is difficult to obtain necessary lift force in the high speed zone. In addition, in this case, in the low speed zone, due to large pressure drag, the flight distance may be decreased.

Even in the case of small-sized dimples having a diameter of less than 0.145, if the depth of the dimples is increased to increase the area, a larger lift force can be obtained. However, in the case where the diameter of the dimple is equal to or less than 0.1 inch, it is impossible to obtain a lift force in the high speed zone. In addition, in the case of small-sized dimples having a diameter of 0.115 inch or more and less than 0.145 inch, if the depth of the dimple is 6% or more of the diameter of the dimple, in the air flow in the high speed zone, the pressure drag is suddenly increased due to occurrence of severe turbulence, so that a hop phenomenon occurs. Therefore, the golf ball is suddenly lifted and suddenly fallen, so that the flight distance is decreased.

In this manner, the small-sized dimples give smaller influence so as to obtain the lift force in the high speed zone than the large-sized dimple. However, the small-sized dimples have a role of suppressing a sudden increase in pressure drag due to the large-sized dimples and of regulating the height of the trajectory. In particular, in the low speed zone, the small-sized dimples have a role of dividing the air flow into small air flows, so that the golf ball is prevented from being swept by wind. Accordingly, the small-sized dimples have a role of securing flight stability.

On the contrary, the small-sized dimple have a problem in that the pressure drag thereof is larger than the pressure drag of the large-sized dimples in the low speed zone where the speed of the golf ball is suddenly decreased.

Therefore, if the large-sized dimples and the small-sized dimples are appropriately mixed to have symmetry in the arrangement of the dimples on the surface of the golf ball, the flight performance can be improved in the high and low speed zones.

Recently, due to a recent tendency to prefer good outer appearance of a golf ball, large circular dimples are required to be formed with similar diameters so that the dimples are seen to be uniform, and a total number of dimple is required to be small, that is, in a range of 300 to 400.

In this dimple pattern, since large-sized dimples having a diameter of 0.145 inch or more are mainly arranged, if the dimples are arranged to have symmetry on the surface of the spherical polyhedron formed with the spherical equilateral polygons which is generally widely used at present, there is a limitation in terms of structure. Namely, a total area ratio of the dimples cannot exceed a range of 80% to 82% of the entire surface area of the spherical body, and in some cases, the total area ratio of the dimples is only in a range of 75% to 77% of the entire surface area of the spherical body.

Therefore, in order to forcibly increase the area ratio of dimples, in some cases, edge portions between the dimples are substantially removed, or the dimples are configured to overlap each other. However, if the golf ball having the above-described configuration is hit by the golf club, the edge portion is easily destructed, and thus, the golf ball is deformed from a circle, so that the golf ball cannot be flown in the desired flying direction.

As described above, due to a recent tendency to prefer good outer appearance of a golf ball, the dimples occupying 80% or more of the surface area of the spherical body constituting the golf ball need to be arranged to have a diameter of 0.145 inch or more. Therefore, the small-sized dimples supporting stable flying are arranged with less than 20%. Accordingly, there is a problem in that the empty portion, that is, the land portion where the dimples are not formed is increased beyond necessity.

By summarizing, if dimples having a diameter of 0.145 inch or more are mainly arranged on the surface of the general spherical polyhedron formed with regular polygons, the land portion where no dimple is formed is inevitably greatly increased, and the number of lands is increased. Therefore, there is a limitation to increase the area ratio of dimples with respect to the entire surface area of the spherical body. Accordingly, there is a problem in that it is difficult to obtain a sufficient lift force of the golf ball, and the flight distance is decreased in the low speed zone after the apex of trajectory.

Korean Patent Application Publication No. 10-1994-0019331 (published on Sep. 14, 1994) is disclosed.

Korean Patent No. 10-0852269 (published on Aug. 7, 2008) is disclosed.

SUMMARY

The present invention is to provide a spherical polyhedron division structure and a dimple pattern of a golf ball capable of minimizing non-dimple portions to maximize an area ratio of dimples and capable of arranging the dimples on the surface of the golf ball to have a complete symmetry in arrangement of the dimples on the surface of a spherical body constituting the golf ball.

According to an aspect of the present invention, there is provided a spherical polyhedron division structure, wherein an arbitrary point on a surface of a spherical body constituting a golf ball is defined as a pole, a great circle dividing the spherical body into a northern hemisphere and a southern hemisphere with respect to the pole as a reference point is defined as an equator, the surface of the spherical body is divided into six areas formed by segments connecting the pole and points obtained by dividing the equator in units of 60°, each area is divided into spherical polygons formed by four spherical rectangles and two spherical triangles having sides with different lengths, and the spherical polygons arranged in different adjacent areas are symmetric with each other.

In the arrangement of the dimples on the surface of the spherical polyhedron, with respect to the segments connecting the pole and the points obtained by dividing the equator in units of 60°, the dimples are arranged to be divided in half along each segment, or the dimples are alternately arranged above and below each segment from the equator to the pole without the dimples touching the segment.

In this case, it is preferable that the dimples having a diameter of 0.145 inch or more occupy 80% or more of the entire dimples and a total number of the dimples be in a range of 300 to 400.

According to the present invention, even in the case where large-sized dimples having a size of 0.145 inch or more are arranged in a spherical body constituting a golf ball, portions with no dimples are minimized, so that it is possible to maximize an area ratio of dimples; and the dimples are arranged to have a complete symmetry over the entire spherical body, so that it is possible to improve a flying distance and to maintain a stable flying direction without leftward or rightward deflection after hitting before landing.

DESCRIPTION OF THE PREFERRED EMBODIMENTS

Unlike the related art where a surface of a spherical body constituting a golf ball is divided into spherical polygons such as spherical equilateral polygons and dimples are arranged, in the present invention, the surface of the spherical body is divided into spherical polygons having sides with different lengths rather than spherical equilateral polygons and dimples are arranged in the spherical polygons to have a complete symmetry.

Hereinafter, a golf ball with a dimple pattern arranged in spherical polygons having sides with different lengths according to the present invention will be described in detail with reference to the attached drawings.

Figure 1:
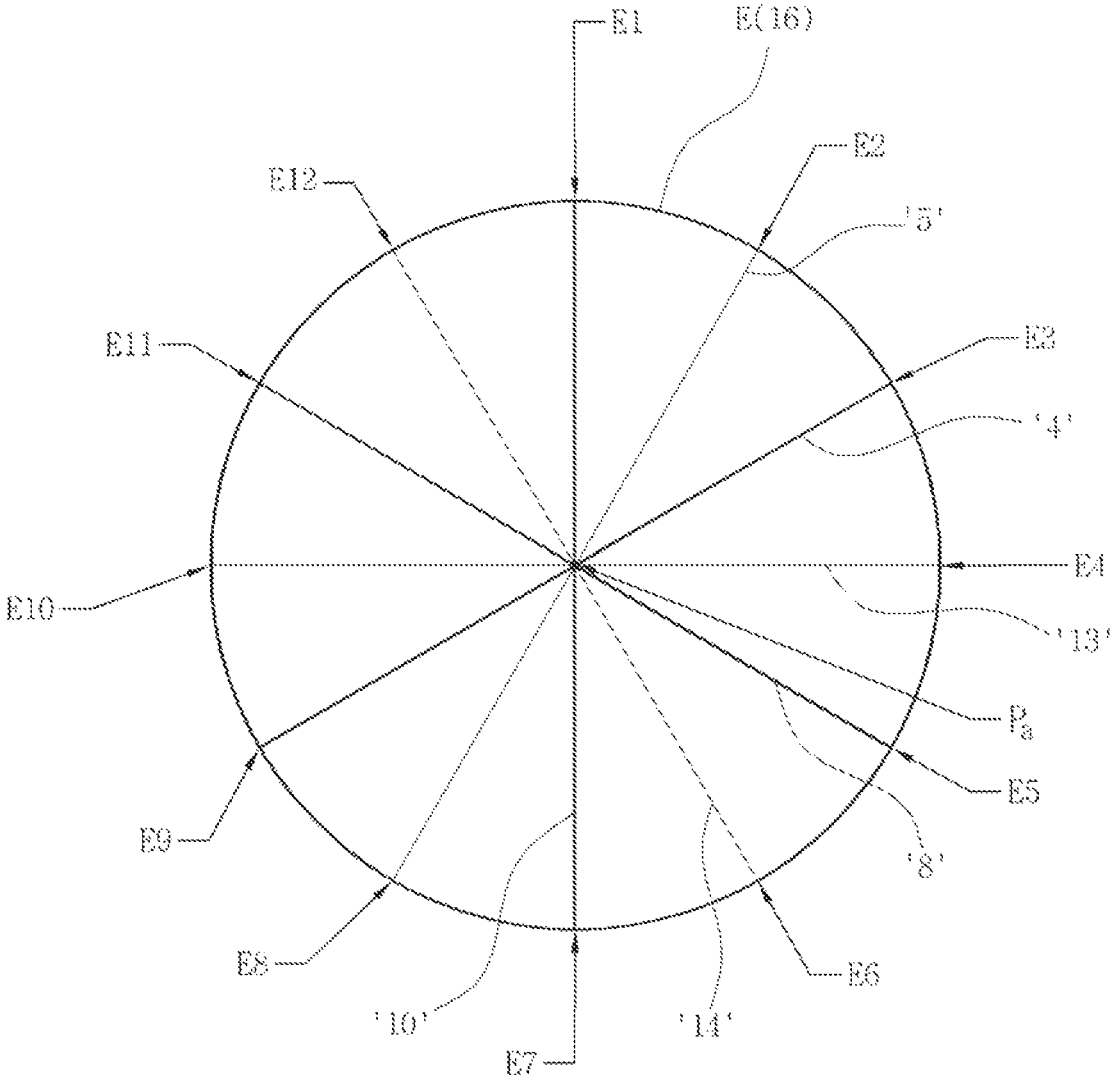
FIG. 1 is a diagram illustrating a golf ball according to the present invention where a surface of a spherical body constituting the golf ball is divided into spherical polygons having sides with different lengths and intersection the points between division lines passing through the pole in an interval of longitude 30° and the equator and the equator are expressed by latitudes La and longitudes Lo.

FIG. 1 is a diagram illustrating a golf ball according to the present invention where a surface of a spherical body constituting a golf ball into spherical polygons having sides with different lengths. In FIG. 1, an arbitrary one the point of the surface of the spherical body is defined as a pole Pa of the spherical body. As the pole Pa is used as a reference point, the spherical body is divided into a northern hemisphere and a southern hemisphere by a great circle which is an equator E. Intersection the points between the division lines passing through the pole Pa and the equator E in an interval of longitude 30° and the equator E are expressed by latitudes La and longitudes Lo.

As illustrated in FIG. 1, division lines are seven great circles. The seven great circles includes one great circle 16 as the equator E and six great circles 4, 8, 10, 13, 14, and 15, each of which connects the pole Pa and the opposite points among 12 points E1 to E12 as intersection points of the equator E arranged in units of longitude 30°.

More specifically, the great circle 16 as the equator E is a line connecting the point E1 (latitude 0° and longitude 90°), the point E4 (latitude 0° and longitude) 0°, the point E7 (latitude 0° and longitude 270°), and the point E10 (latitude 0° and longitude 180°) in FIG. 1.

The great circle 10 is a line passing through the point E1 (latitude 0° and longitude 90°), the pole Pa (latitude 90° and longitude 90°), and the point E7 (latitude 0° and longitude 270°).

The great circle 15 is a line passing through the point E2 (latitude 0° and longitude 60°), the pole Pa, and the point E8 (latitude 0° and longitude 240).

The great circle 4 is a line passing through the point E3 (latitude 0° and longitude 30°), the pole Pa, and the point E9 (latitude 0° and longitude 210°).

The great circle 13 is a line passing through the point E4 (latitude 0° and longitude 0°), the pole Pa, and the point E10 (latitude 0° and longitude 180°).

The great circle 8 is a line passing through the point E5 (latitude 0° and longitude 330°), the pole Pa, and the point E11 (latitude 0° and longitude 150°).

The great circle 14 is a line passing through the point E6 (latitude 0° and longitude 300°), the pole Pa, and the point E12 (latitude 0° and longitude 120°).

Herein, along the bold great circles 4, 8, and 12 connecting the pole Pa and the respective points E3 (latitude 0° and longitude 30°), E5 (latitude 0° and longitude 330°), and E7 (latitude 0° and longitude 270°), the dimples are alternately arranged from the equator E to the pole Pa. This will be described later in detail.

Figure 2:
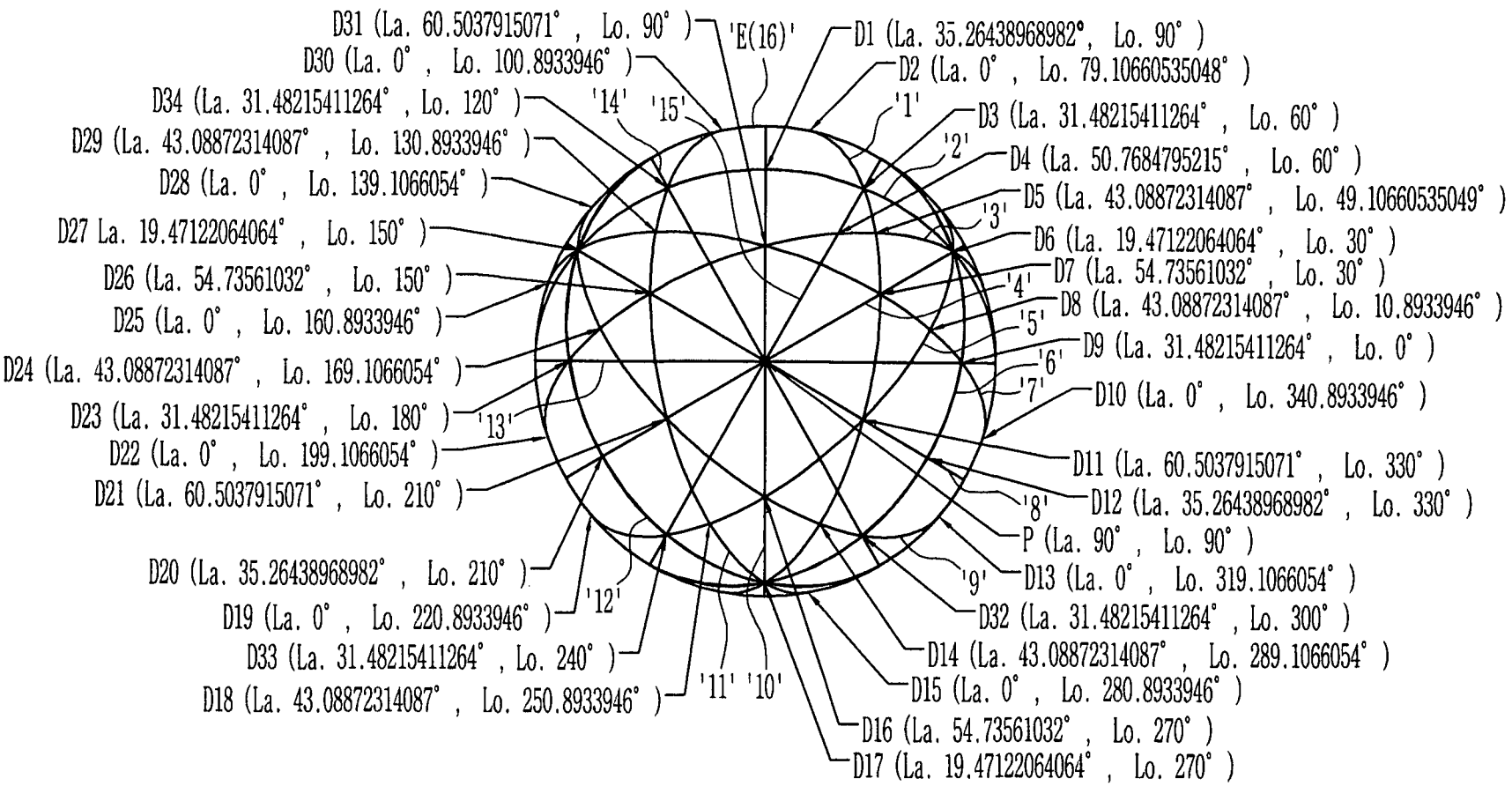
FIG. 2 is a diagram illustrating a golf ball according to the present invention where a surface of a spherical body constituting the golf ball is divided into spherical polygons having sides with different lengths and the points through which division lines pass are expressed by latitudes La and longitudes Lo.

FIG. 2 is a diagram illustrating latitude La and longitudes Lo of points through which division lines other than the division lines illustrated in FIG. 1 pass in the division of the surface of the spherical body constituting the golf ball into spherical polygons having sides with different lengths according to the present invention.

As illustrated in FIG. 2, the division lines are segments formed by 9 great circles 1, 2, 3, 5, 6, 7, 9, 11, and 12 passing through 34 points D1 to D34 on the surface of the spherical body.

The great circle 1 is a line passing through the point D2 (latitude 0° and longitude 79.10660535048°), the point D7 (latitude 54.73561032° and longitude 30°), the point D11 (latitude 60.5037915071° and longitude 330°), and the point D14 (latitude 43.08872314087° and longitude) 289.1066054° in FIG. 2.

The great circle 3 is a line passing through the point D6 (latitude 19.47122064064° and longitude 30°), the point D5 (latitude 43.08872314087° and longitude) 49.10660535049°, the point D26 (latitude 54.73561032° and longitude 150°), and the point D23 (latitude 31.48215411264° and longitude 180°) in FIG. 2.

The great circle 5 is a line passing through the point D6 (latitude 19.47122064064° and longitude 30°), the point D8 (latitude 43.08872314087° and longitude) 10.8933946°, the point D11 (latitude 60.5037915071° and longitude 330°), and the point D18 (latitude 43.08872314087° and longitude 250.8933946°) in FIG. 2.

The great circle 2 is a line passing through the point D6 (latitude 19.47122064064° and longitude 30°), the point D3 (latitude 31.48215411264° and longitude 60°), the point D1 (latitude 35.26438968982° and longitude 90°), and the point D27 (latitude 19.47122064064° and longitude 150°) in FIG. 2.

The great circle 6 is a line passing through the point D6 (latitude 19.47122064064° and longitude 30°), the point D9 (latitude 31.48215411264° and longitude 0°), the point D12 (latitude 35.26438968982° and longitude 330°), and the point D17 (latitude 19.47122064064° and longitude) 270° in FIG. 2.

The great circle 7 is a line passing through the point D10 (latitude 0° and longitude 340.8933946°), the point D7 (latitude 54.73561032° and longitude 30°), the point D31 (latitude 60.5037915071° and longitude 90°), and the point D27 (latitude 19.47122064064° and longitude 150°) in FIG. 2.

The great circle 9 is a line passing through the point D13 (latitude 0° and longitude 319.1066054°), the point D16 (latitude 54.73561032° and longitude 270°), the point D21 (latitude 60.5037915071° and longitude 210°), and the point D27 (latitude 19.47122064064° and longitude 150°) in FIG. 2.

The great circle 11 is a line passing through the point D17 (latitude 19.47122064064° and longitude 270°), the point D21 (latitude 60.5037915071° and longitude 210°), the point D26 (latitude 54.73561032° and longitude 150°), and the point D30 (latitude 0° and longitude 100.8933946°) in FIG. 2.

The great circle 12 is passing through the point D17 (latitude 19.47122064064° and longitude 270°), the point D20 (latitude 35.26438968982° and longitude 210°), the point D23 (latitude 31.48215411264° and longitude 180°), and the point D27 (latitude 19.47122064064° and longitude) 150° in FIG. 2.

In the spherical polyhedron division structure of the spherical body constituting the golf ball according to the present invention, spherical polygons are formed by connecting segments formed by connecting the great circle 16 as the equator E, the six great circles 4, 8, 10, 13, 14, and 15, and the nine great circles 1, 2, 3, 5, 6, 7, 9, 11, and 12 illustrated in FIG. 2; and the surface of the spherical body is divided by six areas formed by the segments connecting the pole Pa and the points E1, E3, E5, E7, E9, and E11 obtained by dividing the equator E in units of 60°, so that the surface of the spherical body is divided into the spherical polygons having sides with different lengths, wherein the spherical polygons in one area are arranged to be completely symmetric with those in another adjacent area. Herein, the great circles constituting spherical polygons are virtual lines for arrangement of dimples, so that the great circles are not actually expressed on the surface of the golf ball.

Figure 3:
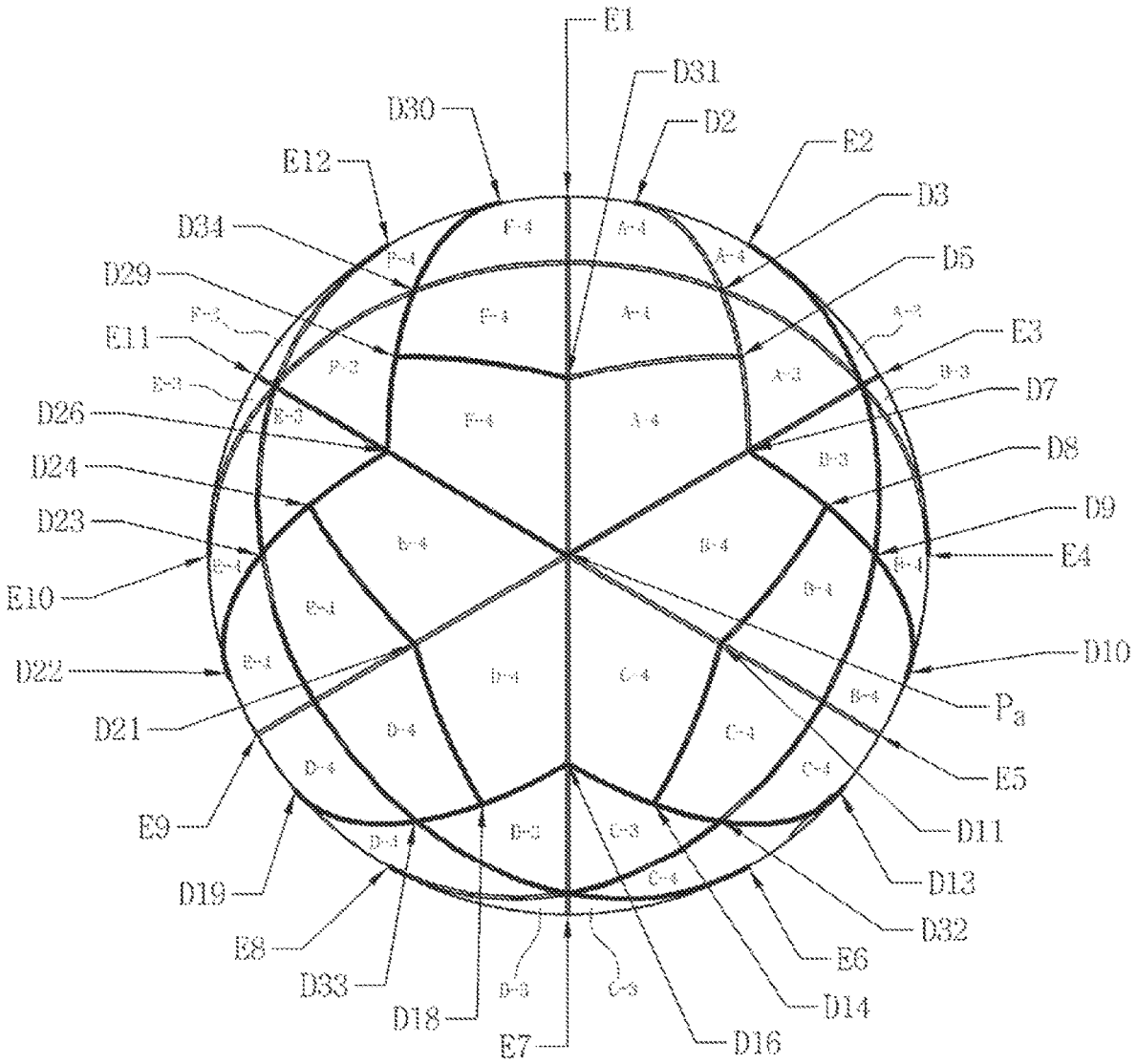
FIG. 3 is a diagram illustrating a golf ball according to the present invention where a surface of a spherical body constituting the golf ball is divided into spherical polygons having sides with different lengths and the spherical polygons divided by the division lines on the surface of the spherical body are indicated by solid lines.

The spherical polyhedron division structure of the spherical polyhedron is illustrated in FIG. 3.

As illustrated in FIG. 3, it can be seen understood that in the six areas A, B, C, D, E, and F formed by the segments connecting the pole Pa and the points E1, E3, E5, E7, E9, and E11 obtained by dividing the equator E in units of 60°, four spherical rectangles and two spherical triangles having sides with different lengths in one area are arranged to be completely symmetric with those of another adjacent area.

For example, four spherical rectangles A-4 and two spherical triangles A-3 having sides with different lengths are arranged in the area A formed by segments connecting the pole Pa and the point E1 and the point E3 among the points dividing the equator E in units of 60°; four spherical rectangles B-4 and two spherical triangles B-3 having sides with different lengths are arranged to be completely symmetric with those of the area A in the adjacent area B; and four spherical rectangles F-4 and two spherical triangles F-3 having sides with different lengths are arranged to be completely symmetric with those of the area A in another adjacent area F.

In this case, in three areas A-B, C-D, and E-F or F-A, B-C, and D-E formed by the segments connecting the pole Pa and the points E3, E7, and E11 or the points E5, E9, and E1 obtained by dividing the equator E in units of 120° in the six areas A, B, C, D, E, and F, the spherical polygons in one area are also arranged to be completely symmetric with those of another adjacent area.

Furthermore, in two areas A-B-C and E-D-F or the like formed by the segments connecting the pole Pa and the points E1 and E7, the points E3 and E9, or the points E5 and E11 obtained by dividing the equator E in units of 180° in the six areas A, B, C, D, E, and F, the spherical polygons in one area are also arranged to be completely symmetric with those of another adjacent area.

In the golf ball according to the present invention, the surface of the spherical polyhedron is divided into spherical triangles having sides with different lengths and having different angles or is divided into spherical rectangles having side with different lengths and having different angles. In this manner, the spherical polyhedron as the golf ball according to the present invention is greatly different from a generally-used spherical polyhedron formed by spherical equilateral polygons. Therefore, unlike the related art, even in the case where large-sized dimples having a diameter of 0.145 inch or more are arranged, non-dimple portions can be minimized, so that the area ratio of dimples can be maximized.

Furthermore, with respect to the six areas formed by segments connecting the pole Pa of the spherical body and the points obtained by dividing the equator in units of longitude 60°, the spherical polygons having sides with different lengths in different adjacent areas are arranged to be completely symmetric with each other, so that it is possible to easily implement dimple arrangement with a complete symmetry over the entire spherical body.

Hereinafter, a dimple pattern arranged to be symmetrically over the entire spherical body having the spherical polyhedron division structure illustrated in FIG. 3 will be described with reference to FIG. 4.

Figure 4:
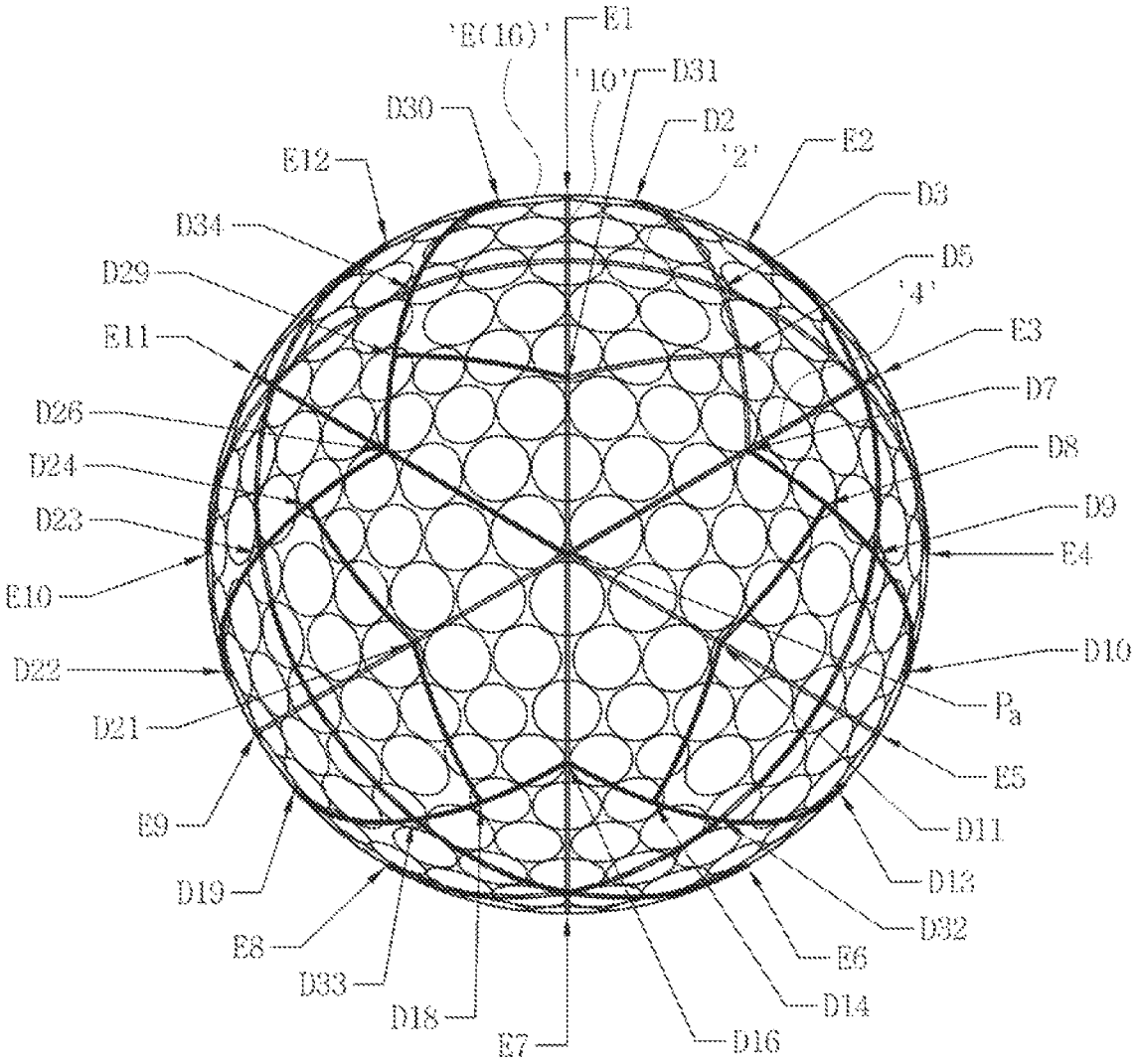
FIG. 4 is a diagram illustrating a golf ball according to the present invention where a surface of a spherical body constituting the golf ball is divided into spherical polygons having sides with different lengths and a dimple pattern is formed so that dimples are arranged to have a complete symmetry on the entire spherical body.

Referring to FIG. 4, first, dimples are arranged along the great circle 16 from the point E1 as a start the point of the great circle 16, that is, the equator E. If a row of the dimples arranged along the equator E (great circle 16) is referred to as a first row, the dimples of the second row are located at the positions between the dimples of the first row.

When the dimples are arranged in the spherical polygons in this manner, some small-sized lands where no dimple exists may be formed between the spherical polygons. However, the size of the land is much smaller than that of the lands existing in the arrangement of dimples in spherical equilateral polygons of a spherical polyhedron of the related art.

More specifically, first, dimples are arranged from the positions close to the equator E within the area formed by the bold segments connecting the points E1, D2, D5, and D31. In this case, the size of the dimples arranged along the solid segment connecting the points D3 and D34 in the great circle 2 is determined so that each of the dimples is divided in half by the bold segment (in actual case, since the segments are divided in half with respect to a portion of the great circle 10 expressed by the bold solid line connecting the points E1 and D31, the dimples are arranged only in the half of the segment connecting the point D3 and D34)

Next, dimples are arranged from the positions close to the equator E within the area formed by the solid segments connecting the points D2, E3, and D7. In this case, similarly to the above-described case, the dimples of the second row are located at the positions between the dimples of the first row. Next, the dimples are arranged with an appropriate size along the solid segment connecting the points D5, the point D7, the pole Pa, and the point D31.

Due to the above-described arrangement of the dimples, the dimples are arranged on ½ of the entire surface area of the golf ball (1/16 of the surface of the northern hemisphere of the golf ball) as the arrangement of the dimples in the bold segment connecting the points E1, the point E3, and the pole Pa.

If the dimples are arranged in the adjacent areas in this manner, the dimples can be arranged in the segment connecting the point E1, the point E11, and the pole Pa to have a complete symmetry by the bold segment connecting the point E1 and the pole Pa. In addition, similarly, the dimples can be arranged in the segment connecting the point E3, the point E5, and the pole Pa to have a complete symmetry by the bold segment connecting the point E3 and the pole Pa.

If the dimples are arranged sequentially in this manner, the dimples can be arranged to have a complete symmetry over the entire spherical body.

As one of features of the dimple pattern in the spherical polyhedron division structure according to the present invention, with respect to the segments passing through the pole Pa (the segment connecting the point E1 and E7, the segment connecting the point E3 and E9, and the segment connecting the point E5 and E11), the dimples are arranged to be divided in half along each segment, or the dimples are arranged to be symmetric with each segment without the dimples touching the segment.

More specifically, in FIG. 4, in the segment 10 connecting the point E1, the pole Pa, and the point E7, the dimples of the first row above the great circle 16 as the equator E with respect to the solid segment from the point E1 to the pole Pa as a center are arranged without touching, the dimples of the second row are arranged to be divided in half, the dimples of the third row are arranged without touching, and the dimples of the next row are arranged to be divided in half, in this alternating manner.

In addition, in the segment 4 connecting the point E3 (separated by longitude 60° from the point E1), the pole Pa, and the point E9, the dimples of the first row with respect to the solid segment from the point E3 to the pole Pa as a center are arranged to be divided in half, the dimples of the second row are arranged without touching, the dimples of the third row are arranged to be divided in half, and the dimples of the next row are arranged without touching in this alternating manner. In this manner, according to the present invention, in the segments separated from the point of latitude 0 and longitude 0° by longitude 60° with respect to the pole as a center, the dimples are alternately arranged from the equator to the the pole (in the case where the dimples are arranged on the segment, the dimples are divided accurately in half by the segment), and the dimples are arranged to have a complete symmetry with respect to the segment.

Hereinbefore, although the spherical polyhedron division structure and the dimple pattern in the northern hemisphere above the equator E dividing the spherical body constituting a golf ball into northern and southern hemispheres are described, the same spherical polyhedron division structure and dimple pattern are applied to the southern hemisphere below the equator E.

In this case, it is preferable that the dimples having a diameter of 0.145 inch or more occupy 80% or more of the entire dimples and a total number of the dimples be in a range of 300 to 400 so that dimples can be arranged with uniform outer appearance over the entire spherical body including the northern hemisphere and the southern hemisphere.

As described hereinbefore, according to the present invention, even in the case where large-sized dimples having a diameter of 0.145 inch or more are arranged in a spherical body constituting a golf ball, non-dimple portions can be minimized, so that the area ratio of dimples can be maximized. In addition, the dimples can be arranged to have a complete symmetry over the entire spherical body.

What is claimed is:

1. A golf ball comprising:

a dimple pattern of dimples on the golf ball that are arranged according to spherical polygons having sides with different lengths and land area formed in between the dimples, wherein an arbitrary point on a land area of a spherical body constituting the golf ball is defined as a northern pole Pa, a southern pole Pa defined on a land area directly opposite the northern pole Pa, the dimple pattern comprising three dimples directly adjacent to the northern pole Pa land area, wherein a great circle dividing the spherical body into a northern hemisphere and a southern hemisphere with respect to the northern and southern poles Pa as equidistant reference points is defined as an equator E, wherein the northern hemisphere of the spherical body is divided into six adjacent areas formed by segments connecting points E1, E3, E5, E7, E9, and E11 obtained by dividing the equator E in units of 60° and passing through the northern pole Pa, wherein each of the six areas is divided into spherical polygons formed by four spherical polygons each having four different-length sides and two spherical triangles having different side lengths, wherein when points E1 to Pa to E7, E3 to Pa to E9, and E5 to Pa to E11 are connected to form three segments, each of the three segments successively alternates along the entirety of the segments between dividing in half dimples arranged along the segments, including one pole dimple, and positioning, without dividing, pairs of dimples directly adjacent to the sides of the segments, including the other two pole dimples wherein the southern hemisphere has the same spherical polyhedron division structure and dimple pattern as the northern hemisphere, and wherein the dimples arranged in each of the six areas are mirror symmetric with the dimples arranged in another adjacent area.

2. The golf ball according to claim 1, wherein the surface of the spherical body is divided by a great circle 1 passing through a point D2 (latitude 0° and longitude 79.10660535048°), a point D7 (latitude 54.73561032° and longitude 30°), a point D11 (latitude 60.5037915071° and longitude 330°), and a point D14 (latitude 43.08872314087° and longitude 289.1066054°); the surface of the spherical body is divided by a great circle 3 passing through a point D6 (latitude 19.47122064064° and longitude 30°), a point D5 (latitude 43.08872314087° and longitude 49.10660535049°), a point D26 (latitude 54.73561032° and longitude 150°), and a point D23 (latitude 31.48215411264° and longitude 180°); the surface of the spherical body is divided by a great circle 5 passing through the point D6 (latitude 19.47122064064° and longitude 30°), a point D8 (latitude 43.08872314087° and longitude 10.8933946°), the point D11 (latitude 60.5037915071° and longitude 330°), and a point D18 (latitude 43.08872314087° and longitude 250.8933946°); the surface of the spherical body is divided by a great circle 2 passing through the point D6 (latitude 19.47122064064° and longitude 30°), the point D3 (latitude 31.48215411264° and longitude 60°), the point D1 (latitude 35.26438968982° and longitude 90°), and the point D27 (latitude 19.47122064064° and longitude 150°); the surface of the spherical body is divided by a great circle 6 passing through the point D6 (latitude 19.47122064064° and longitude 30°), the point D9 (latitude 31.48215411264° and longitude 0°), the point D12 (latitude 35.26438968982° and longitude 330°), and the point D17 (latitude 19.47122064064° and longitude 270°); the surface of the spherical body is divided by a great circle 7 passing through the point D10 (latitude 0° and longitude 340.8933946°), the point D7 (latitude 54.73561032° and longitude 30°), the point D31 (latitude 60.5037915071° and longitude 90°), and the point D27 (latitude 19.47122064064° and longitude 150°); the surface of the spherical body is divided by a great circle 9 passing through the point D13 (latitude 0° and longitude 319.1066054°), the point D16 (latitude 54.73561032° and longitude 270°), the point D21 (latitude 60.5037915071° and longitude 210°), and the point D27 (latitude 19.47122064064° and longitude 150°); the surface of the spherical body is divided by a great circle 11 passing through the point D17 (latitude 19.47122064064° and longitude 270°), the point D2 (latitude 60.5037915071° and longitude 210°), the point D26 (latitude 54.73561032° and longitude 150°), and the point D30 (latitude 0° and longitude 100.8933946°); the surface of the spherical body is divided by a great circle 12 passing through the point D17 (latitude 19.47122064064° and longitude 270°), the point D20 (latitude 35.26438968982° and longitude 210°), the point D23 (latitude 31.48215411264° and longitude 180°), and the point D27 (latitude 19.47122064064° and longitude 150°); the equator is divided by 12 points E1 to E12 in units of longitude 30°; the equator is defined by a great circle 16 passing through the point E1 (latitude 0° and longitude 90°), the point E4 (latitude 0° and longitude 0°), the point E7 (latitude 0° and longitude 270°), and the point E10 (latitude 0° and longitude 180°); the surface of the spherical body is divided by a segment 10 connecting the point E1 (latitude 0° and longitude 90°), the pole Pa (latitude 90° and longitude 90°), and the point E7 (latitude 0° and longitude 270°); the surface of the spherical body is divided by a segment 15 connecting the point E2 (latitude 0° and longitude 60°), the pole Pa, and the point E8 (latitude 0° and longitude 240°); the surface of the spherical body is divided by a segment 4 connecting the point E3 (latitude 0° and longitude 30°), the pole Pa, and the point E9 (latitude 0° and longitude 210°); the surface of the spherical body is divided by a segment 13 connecting the point E4 (latitude 0° and longitude 0°), the pole Pa, and the point E10 (latitude 0° and longitude 180°); the surface of the spherical body is divided by a segment 8 connecting the point E5 (latitude 0° and longitude 330°), the pole Pa, and the point E11 (latitude 0° and longitude 150°); the surface of the spherical body is divided by a segment 14 connecting the point E6 (latitude 0° and longitude 300°), the pole Pa, and the point E12 (latitude 0° and longitude 120°), so that the surface of the spherical body is divided by spherical polygons including a plurality of spherical triangles and a plurality of spherical rectangles having sides with different lengths.

3. The golf ball according to claim 2, wherein with respect to the segment connecting the point D3 and the point D34, the segment connecting the point D9 and the point D32, and the segment connecting the point D23 and the point D33, the dimples are divided in half along each of the segments.

4. The golf ball according to claim 2, wherein the dimples having a diameter of 0.145 inch or more occupy 80% or more of the entire dimples.

5. The golf ball according to claim 2, wherein a total number of the dimples is in a range of 300 to 400.

* * * * *